United States Patent [19]

Sakamoto et al.

[11] Patent Number: 4,982,906

[45] Date of Patent: Jan. 8, 1991

[54] MULTI-CHAMBER INCLINED BALL MILL

[75] Inventors: Hiroshi Sakamoto, Tsukuba; Mitsuru Yamamoto, Ushiku; Hitoshi Ohya, Tsukuba, all of Japan

[73] Assignee: Agency of Industrial Science & Technology, Ministry of International Trade & Industry, Tokyo, Japan

[21] Appl. No.: 493,336

[22] Filed: Mar. 14, 1990

[30] Foreign Application Priority Data

Mar. 17, 1989 [JP] Japan ..... 1-67226

[51] Int. Cl.[5] ..... B02C 17/18

[52] U.S. Cl. ..... 241/179

[58] Field of Search ..... 241/176, 177, 179

[56] References Cited

U.S. PATENT DOCUMENTS

| | | | |
|---|---|---|---|
| 2,012,602 | 8/1935 | Forrester | 241/179 X |
| 2,118,628 | 5/1938 | Gernet | 241/179 X |
| 2,849,190 | 8/1958 | Everett et al. | 241/179 X |
| 3,949,942 | 4/1976 | Haas et al. | 241/179 |
| 4,085,898 | 4/1978 | Jacnsach et al. | 241/179 X |

FOREIGN PATENT DOCUMENTS

| | | |
|---|---|---|
| 60-31836 | 2/1985 | Japan . |
| 144089 | 9/1989 | Japan . |

*Primary Examiner*—Timothy V. Eley

*Attorney, Agent, or Firm*—Oblon, Spivak, McClelland, Maier & Neustadt

[57] ABSTRACT

A multi-chamber inclined ball mill comprises a base, a frame-shaped support member rotatably supported on the base, and a grinding chamber rotatably supported on the frame-shaped support member. The grinding chamber is constituted of at least three cylindrical chambers each provided with outwardly tapered protrusions at its opposite ends and the cylindrical chambers integrally formed so that their longitudinal axes mutually intersect at the centers thereof and form a common grinding space at their region of intersection. The grinding chamber is supported on the frame-shaped support member such that the longitudinal axes of the cylindrical chambers intersect the axis of rotation of the frame-shaped support member at a single point and at one and the same angle.

5 Claims, 4 Drawing Sheets

MULTI-CHAMBER INCLINED BALL MILL

BACKGROUND OF THE INVENTION

1. Field of the Invention

This invention relates to a multi-chamber inclined ball mill which is used for producing ultra fine particles by grinding a material using a grinding media.

2. Prior Art Statement

Ultra fine particles possess a wide variety of physical and chemical properties and as such are a focus of attention in connection with functional materials in such sectors as electronic materials and fine ceramics.

As an apparatus for producing such ultra fine particles the present inventors have proposed an inclined ball mill having a cylindrical grinding chamber which is rotated in an inclined attitude. (See Japanese Patent Public Disclosure No. 60-31836.)

As shown in FIG. 1, the cylindrical grinding chamber 1 of this earlier inclined ball mill is supported within a support frame 2 so as to be fixed at a prescribed angle $\theta$ by a support member 3. A support shaft 4 extending beyond the opposite ends of the support frame 2 is rotatably supported on mounts 6 so that when the support shaft 4 is rotated by a motor 5, the cylindrical grinding chamber 1 is rotated such that its left and right ends alternate in their higher-lower relationship once every half turn. Differently from a ball mill that does not have an inclined shaft, this arrangement enables three-dimensional movement by the grinding media and, as a result, makes it possible to reduce the particle size of the material being ground to the sub-micron order.

The inventors further proposed an improved version of the aforesaid inclined ball mill in which two grinding chambers 1*a*, 1*b* are arranged to intersect at their respective centers so as to form a cruciform cylindrical grinding chamber 1. (See Japanese Patent Public Disclosure No. 2-11557.)

Studies conducted by the inventors show, however, that in these earlier inclined ball mills the fact that the grinding chamber is almost constantly inclined causes the grinding media to collect at the lower end or ends so that a very large torque is required up to the time that the support shaft 4 has rotated 90°, i.e. until the grinding chamber is horizontal. Then when the support shaft 4 rotates beyond 90°, the grinding media shifts toward what is now the lower end so that from this point on up to 180° of rotation, the direction of rotation and the direction of the rotational moment caused by the weight of the grinding media are the same, whereby the rotation is promoted and a negative torque is produced. The torque fluctuation is thus extremely large and the balance in the direction of rotation poor. Further, the grinding media is rarely present at the center of the rotational axis midway between the two bearing. This means that the weight of the grinding media is almost always shifted to the left or right, making the balance in the axial direction bad as well. When the torque was actually measured, the value output by the torque meter fluctuated greatly.

When the balance is bad in one or both of the rotational and axial directions, the energy efficiency becomes poor.

OBJECT AND SUMMARY OF THE INVENTION

This invention was accomplished in light of the foregoing problems of the prior art. Its object is to provide an inclined ball mill wherein torque fluctuation is reduced and energy efficiency increased by improving the mechanical balance in both the direction of the drive shaft and the direction of rotation while maintaining the three-dimensional movement of the grinding media in the grinding chamber.

For realizing this object the present invention provides an inclined ball mill comprising a base, a frame-shaped support member rotatably supported on the base, and a grinding chamber rotatably supported on the frame-shaped support member, the grinding chamber being constituted of at least three cylindrical chambers each provided with outwardly tapered protrusions at its opposite ends, the cylindrical chambers being integrally formed to have their longitudinal axes mutually intersect at the centers thereof and to form a common grinding space at their region of intersection, the grinding chamber being supported on the frame-shaped support member such that the longitudinal axes of the cylindrical chambers intersect the axis of rotation of the frame-shaped support member at a single point and at one and the same angle.

As set out above, the ball mill according to the present invention has a grinding chamber constituted of at least three cylindrical chambers which are disposed at equal intervals about the axis of rotation of the grinding chamber such that their longitudinal axes are inclined with respect to the axis of rotation at one and the same angle. Thus, while the ball mill can enable the three-dimensional movement of the grinding media, which is a key advantage of the inclined ball mill, it also has the additional advantages that, owing to the fact that only a portion of the grinding media shifts approximately every 60° of rotation (in the case of three cylindrical chambers), the mechanical balance in both the direction of the drive shaft and in the direction of rotation is improved, the torque fluctuation is consequently reduced, and the energy efficiency is increased as a result.

The above and other features of the present invention will become apparent from the following description made with reference to the drawings.

DETAILED DESCRIPTION OF THE PREFERRED EMBODIMENT

Figure 1:
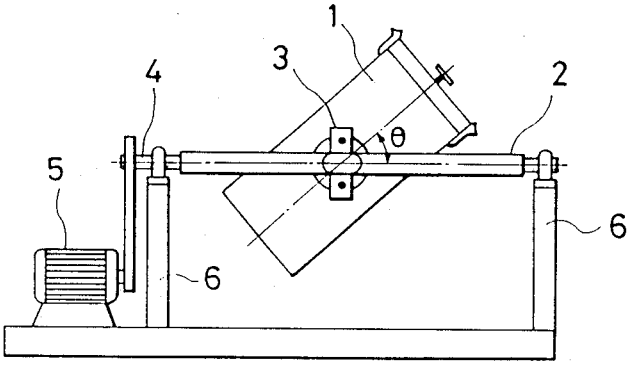
FIG. 1 PRIOR ART
FIG. 1 is a schematic illustration of an example of a conventional inclined ball mill.
Figure 2:
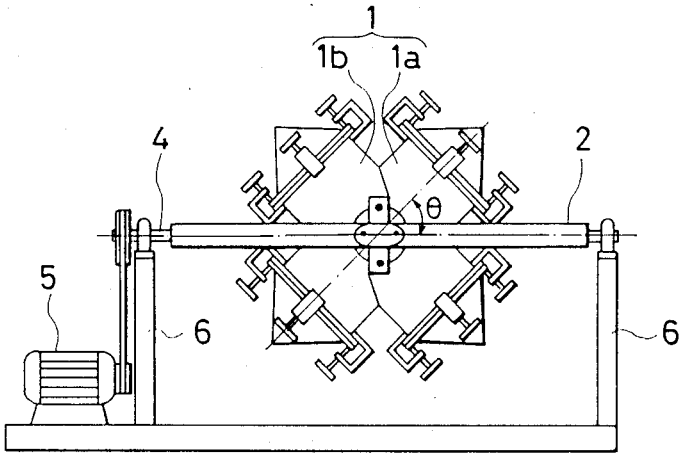
FIG. 2 PRIOR ART
FIG. 2 is a schematic illustration of another example of a conventional inclined ball mill.
Figure 3:
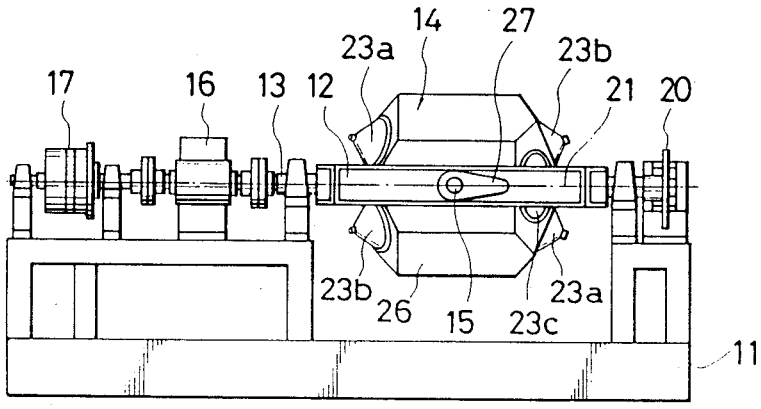
FIG. 3 is a front view of an embodiment of an inclined multi-chamber ball mill according to the present invention.
Figure 4:
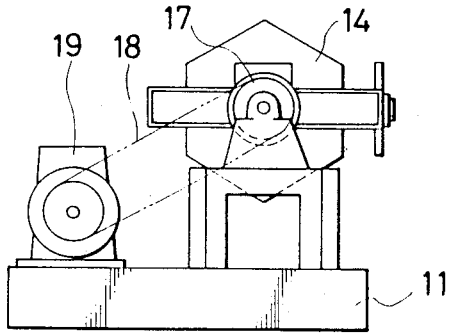
FIG. 4 is a side view of the ball mill shown in FIG. 3.

FIGS. 3 to 8 show an embodiment of a multi-chamber inclined ball mill according to the present invention. In these figures, the reference numeral 3 indicates a triple axis inclined ball mill, 11 a base for supporting the ball mill, 12 a rectangular support member rotatably supported on the base 11 via a drive shaft 13 and used for supporting and rotating a grinding chamber, and 14 a grinding chamber mounted within the support member 12 via a mounting shaft 15. The drive shaft 13 of the support member 12 for rotating the grinding chamber 14 is connected via a torque meter 16, an electromagnetic clutch 17 and a belt 18 with a motor 19 serving as a power source. The other end of the drive shaft 13 is provided with a disk brake 20 and when the drive shaft 13 is driven by the motor 19, the support member 12 and the grinding chamber 14 rotate about the center axis 21 of the drive shaft 13.

As shown in FIGS. 5 to 8, the grinding chamber 14 is constituted of three cylindrical chambers 24a, 24b, 24c having respective pairs of outwardly tapered protrusions 23a, 23b, 23c at their opposite ends. The cylindrical chambers 24a, 24b, 24c are disposed surrounding the center axis of rotation 21 so as to be spaced at equal intervals in the circumferential direction. They are formed as a unitary body such that the centers of their respective longitudinal axes 25a, 25b, 25c intersect at a single point on the center axis 21. As a result of this arrangement, the cylindrical chambers 24a, 24b, 24c share a common grinding space 22 at the region of their intersection and this region is covered by a shell member 26. The grinding chamber 14 is supported with respect to the center axis of rotation 21 of the support member 12 such that each of the longitudinal axis 25a, 25b and 25c of the cylindrical chambers 24a, 24b and 24c make the same prescribed angle of inclination $\theta$ with respect to the center axis 21. This angle of inclination $\theta$ is preferably within the range of 30–45. So as not to provide any dead space where the grinding media can easily accumulate during grinding, it is further preferable to form the protrusions 23a, 23b, 23c at the extremities of the cylindrical chambers 24a, 24b, 24c to be conical, hemispherical, hemi-ellipsoid or other such shape.

In the figures, reference numeral 27 indicates an adjustment member for adjusting the angle of attachment of the mounting shaft 15 of the grinding chamber 14 with respect to the support member 12.

When material to be ground (hereinafter called "feed") is to be ground using the inclined ball mill of the foregoing arrangement, the adjustment member 27 and the mounting shaft 15 are first used to adjust the grinding chamber 14 with respect to the support member 12 such that the longitudinal axes 25a, 25b, 25c of the cylindrical chambers 24a, 24b, 24c each makes the same prescribed angle with respect to the center axis of rotation 21. Next a feed, e.g. an electronic material, fine ceramic material or the like, is sealed in the grinding chamber 14 together with grinding media such as steel balls or the like, whereafter the support member 12 is rotated by the motor 19. At this time, since the cylindrical chambers 24a, 24b, 24c constituting the grinding chamber 14 rotate about the center axis 21 of the support member 12 as inclined by the prescribed angle $\theta$, the feed and the grinding media execute both rolling movement in the direction of rotation of the grinding chamber 14 and reciprocal movement along the longitudinal axes 25a, 25b, 25c of the cylindrical chambers 24a, 24b, 24c, whereby vigorous three-dimensional movement of the grinding media is achieved. Moreover, since the amount of flying movement is reduced, a large frictional crushing effect is produced. In addition, since the cylindrical chambers 24a, 24b, 24c are formed with the protrusion pairs 23a, 23b, 23c at their opposite ends, the feed and the grinding media can move smoothly and vigorously along the inner surfaces of these protrusions so that there is no stagnation of the feed and grinding media in these regions, whereby the grinding efficiency is enhanced.

Since the three cylindrical chambers 24a, 24b, 24c constituting the grinding chamber 14 are evenly disposed about the center axis of rotation 21, the grinding media is distributed to be present in all of the cylindrical chambers and as a result only a portion of the grinding media shifts once approximately every 60° of rotation. The balance is thus excellent in both the direction of rotation of the grinding chamber 14 and the direction of the center axis of rotation 21, meaning that torque fluctuation is suppressed. As a result, there is realized a dramatic improvement in the efficiency of energy utilization, making it possible to realize a grinding energy efficiency of greater than 1% even in ultra fine grinding.

Figure 5:
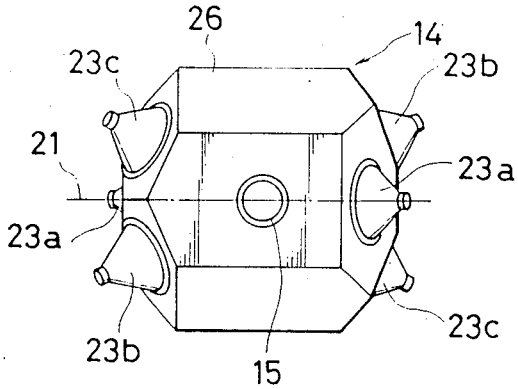
FIG. 5 is a front view of the grinding chamber of the ball mill shown in FIG. 3.
Figure 6:
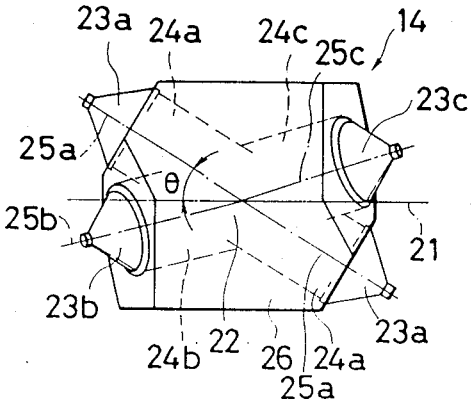
FIG. 6 is an explanatory view showing the angles of inclination between the three cylindrical chambers constituting the grinding chamber shown in FIG. 5 and the axis of rotation.
Figure 7:
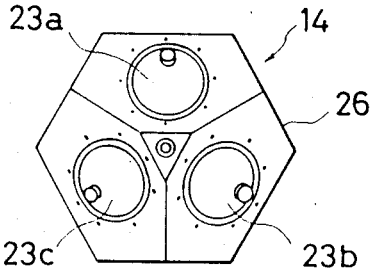
FIG. 7 is a side view of the grinding chamber shown in FIG. 5.
Figure 8:
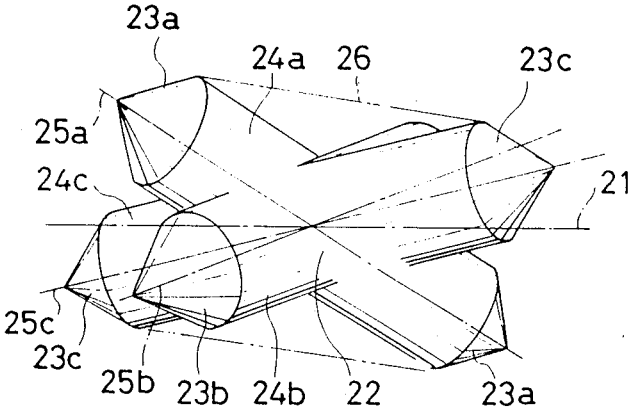
FIG. 8 is a perspective view of the manner in which the cylindrical chambers of the grinding chamber are disposed.

A grinding chamber of the type shown in FIG. 5 was fabricated with three cylindrical chambers each measuring 600 mm in length and 200 mm in inside diameter and was mounted on the support member such that the angle of inclination between the respective longitudinal axes of the cylindrical chambers and the center axis of rotation was 30°. The grinding chamber was charged to about 70% of its volume with 19 mm steel balls serving as grinding media and with a feed consisting of a 34.5% calcium carbonate slurry containing 2 kg of calcium carbonate. The support member was rotated at approximately 80% of its critical rotational speed for grinding the calcium carbonate.

The size of the ground particles was measured at intervals during the period that the grinding chamber was maintained in rotation. The results obtained are shown by the curve a in the graph of FIG. 9. As can be seen from this graph, the calcium carbonate was ground to a median size of 1.2 μm after 16 hours of processing and to 0.8 μm after 60 hours of processing.

By way of comparison, a cylindrical grinding chamber of the type shown in FIG. 1 measuring 200 mm in inside diameter and 400 mm in length was mounted on the support member such that the angle of inclination between its longitudinal axis and the center axis of rotation was 30°. It was charged to about 70% of its volume with 19 mm steel balls serving as grinding media and with a feed consisting of a 34.5% calcium carbonate slurry containing 2 kg of calcium carbonate. The support member was again rotated at approximately 80% of its critical rotational speed for grinding the calcium carbonate.

Figure 9:
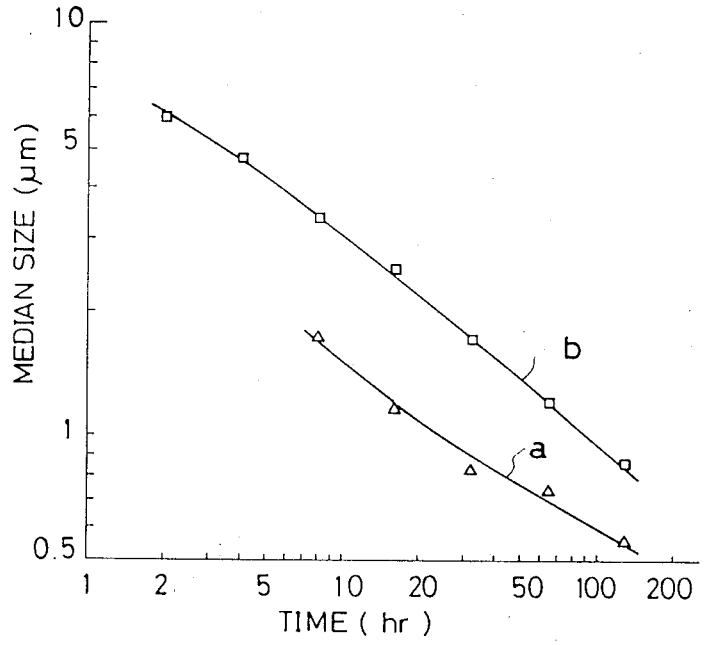
FIG. 9 is a graph showing the relationship between processing time and ground particle size when a material is ground using the ball mill according to this invention.

The results obtained in this case are represented by the curve b in the graph of FIG. 9. It will be noted that the calcium carbonate was ground to a median size of 2.5 μm after 16 hours of processing and that 100 hours or more were required to grind the calcium carbonate to a median size of 1 μm or less.

Thus in the multi-chamber inclined ball mill according to the present invention, the movement of the grinding media is such as to promote the frictional crushing effect, which is considered to be the most important effect in the grinding action of the grinding media, beyond that obtainable with the conventional inclined ball mill and, as a result, the grinding performance is upgraded and sub-micron particles can be efficiently produced in large quantity.

Also, since the number of mixing and blending operations that the grinding media and feed are subjected to during each revolution of the grinding chamber is proportional to the number of cylindrical chambers, the multi-chamber inclined ball mill according to this invention can also be used as a blender.

As explained in the foregoing, the multi-chamber inclined ball mill according to the present invention is provided with at least three cylindrical chambers which are disposed at equal intervals about, and at the same prescribed angle with respect to, the axis of rotation of the grinding chamber. Thus, while maintaining the same capability for three-dimensional movement of the grinding media, which is a key advantage of the inclined ball mill, there is realized an improvement in the mechanical balance in both the direction of rotation and the direction of the rotational axis, a reduction in torque fluctuation, and an improvement in energy efficiency.

It should be noted that while the illustrated embodiment of the grinding chamber is constituted of three cylindrical chambers, it is alternatively possible to constitute the same from four or more cylindrical chambers centered on the axis of rotation. When this is done, the torque fluctuation decreases and the energy efficiency increases in proportion as the number of cylindrical chambers is increased.

What is claimed is:

1. A multi-chamber inclined ball mill comprising a grinding chamber constituted of at least three cylindrical chambers integrally formed to have their longitudinal axes intersect and to form a common grinding space in their region of intersection, a support member for supporting and driving the grinding chamber which is itself supported to rotate about an axis of rotation, the support member supporting the grinding chamber such that the longitudinal axes of the cylindrical chambers make one and the same angle with the axis of rotation, and rotational drive means for rotatingly driving the support member.

2. A ball mill according to claim 1 wherein the at least three cylindrical chambers are disposed at equal intervals in the circumferential direction about the axis of rotation at the center.

3. A ball mill according to claim 1 wherein the at least three cylindrical chambers are supported by the support member such that their longitudinal axes make an angle in the range of 30–45° with respect to the axis of rotation.

4. A ball mill according to claim 1 wherein each of the at least three cylindrical chambers has outwardly tapered protrusions at its opposite ends.

5. A ball mill according to claim 1 wherein the number of the at least three cylindrical chambers is three.

* * * * *